US006272776B1

(12) United States Patent
Santorsola

(10) Patent No.: US 6,272,776 B1
(45) Date of Patent: Aug. 14, 2001

(54) DISPLAY

(76) Inventor: Alan J. Santorsola, 6002 Beacon Ave S., Seattle, WA (US) 98108

( * ) Notice: Subject to any disclaimer, the term of this patent is extended or adjusted under 35 U.S.C. 154(b) by 0 days.

(21) Appl. No.: 09/460,579

(22) Filed: Dec. 14, 1999

Related U.S. Application Data

(62) Division of application No. 09/141,235, filed on Aug. 27, 1998, now abandoned.

(51) Int. Cl.[7] ..... G09F 1/00

(52) U.S. Cl. ..... 40/124.191; 40/495; 116/316; 446/149

(58) Field of Search ..... 40/124.01, 113, 40/115, 124.191, 445, 492, 495, 701, 706; 229/92.8; 116/309, 316, 315, 318; 434/78, 104, 368, 402, 404; 446/147, 149, 151, 152

(56) References Cited

U.S. PATENT DOCUMENTS 2,512,023 * 6/1950 Johnson ..... 40/757 X
2,755,577 * 7/1956 Greensfelder ..... 40/495 X
4,585,231 * 4/1986 Batmanghlich ..... 273/155
5,669,165 * 9/1997 Santorsola ..... 40/124.191

* cited by examiner

*Primary Examiner*—Brian K. Green
(74) *Attorney, Agent, or Firm*—Robert W. Jenny

(57) ABSTRACT

A first plastic film transparency (10) is formed to include an image (14). A second plastic film transparency (12) is formed to include a complementary image (16). The transparencies (10, 12) are positioned side-by-side. The first transparency (10) is formed to include a circle of circumferentially spaced apart incisions (18) in it. The second transparency (12) includes film portions (20) that project through the incisions (18) and connect the transparencies (10, 12) together for at least some rotation, one relative to the other. One transparency (10, 12) can be rotated relative to the other to bring the images (14, 16) into a predetermined relationship, each to the other, so that the two images (14, 16) when viewed together will provide a predetermined combined image.

1 Claim, 5 Drawing Sheets

DISPLAY

RELATED APPLICATION

This application is a divisional of U.S. Ser. No. 09/141,235, filed Aug. 27, 1998, now abandoned, and entitled A Display.

TECHNICAL FIELD

The present invention relates to a variation of the invention disclosed and claimed in my U.S. Pat. No. 5,669,165, granted Sep. 23, 1997 and entitled "Picture Card". More particularly, it relates to a display formed of two or more transparencies that are connected together in a way permitting rotation of at least one of the transparencies relative to the other transparency or transparencies, for the purpose of moving complementary images on the transparencies into and out of registry with each other.

BACKGROUND OF THE INVENTION

The Background Of The Invention set forth in my aforementioned U.S. Pat. No. 5,669,165 is hereby incorporation herein by this specific reference. An object of the present invention is to provide displays that in concept are like the displays disclosed in my U.S. Pat. No. 5,669,165, but which are characterized by new and unique structure for connecting the transparencies together and/or supporting the transparencies for rotation, one relative to another.

DISCLOSURE OF THE INVENTION

Displays of the present invention are basically characterized by a first plastic film transparency having an image on it and a second plastic film transparency having an complementary image on it. The first and second transparencies are positioned side-by-side. The first transparency has a circle of circumferentially spaced apart incisions in it. The second transparency includes film portions that project through the incisions in the first transparency and connect the transparencies together for at least some rotation, one relative to the other. Owing to this construction, one transparency can be rotated relative to the other to bring the images into a predetermined relationship, each to the other, so that the two images when viewed together will provide a predetermined combined image.

According to an aspect of the invention, the film portions of the second transparency that project through the incisions in the first transparency are peripheral portions of the second transparency.

According to another aspect of the invention, the incisions in the first transparency form radially outwardly directed flaps, and the peripheral portions of the second transparency extend radially outwardly through and beyond the incisions, along side the flaps.

According to another aspect of the invention, a third plastic film transparency is positioned along side the first transparency, on the side thereof opposite the second transparency. The first transparency has a second set of circumferentially spaced apart incisions in it. The third transparency includes film portions that project through the second incisions in the first transparency and connect the first and third transparencies together for at least some rotation of the third transparency relative to the first transparency.

The film portions of the third transparency that project through the second incisions in the first transparency may be peripheral portions of the third transparency. The second incisions in the first transparency may also form radially directed flaps. The peripheral portions of the third transparency may extend radially through and radially outwardly from the second incisions, along side the flaps formed by the second incisions.

According to yet another aspect of the invention, the second transparency may include incisions that form radially directed flaps constituting the film portions of the second transparency that project through the incisions in the first transparency. These flaps are circumferentially shorter than the incisions in the first transparency, so that some rotation of the transparencies is permitted.

According to yet another aspect of the invention, first and second circular transparencies of different diameters are connected together, one for rotation relative to the other, and the transparencies are slid, into an envelope that includes opposite sides and openings in the sides that are smaller than the diameters of the transparencies. The envelope is adapted to permit one to grasp the transparencies through the windows and move a peripheral edge portion of the larger transparency into contact with an interior portion of the envelope. This contact of the peripheral edge portion of the larger transparency with the envelope holds the larger transparency against rotation, allowing one to touch the smaller transparency where it is exposed through a side opening in the envelope, and rotate it relative to the larger transparency.

These and other advantages, and objects of the present invention will become apparent from the following detailed description of the best mode, when read together with the drawings, and the claims, which are all incorporated herein as part of the disclosure of the invention.

BRIEF DESCRIPTION OF THE DRAWINGS

Like reference numerals are used to indicate like parts throughout the various figures of the drawing, and.

BEST MODE FOR CARRYING OUT THE INVENTION

Figure 1:
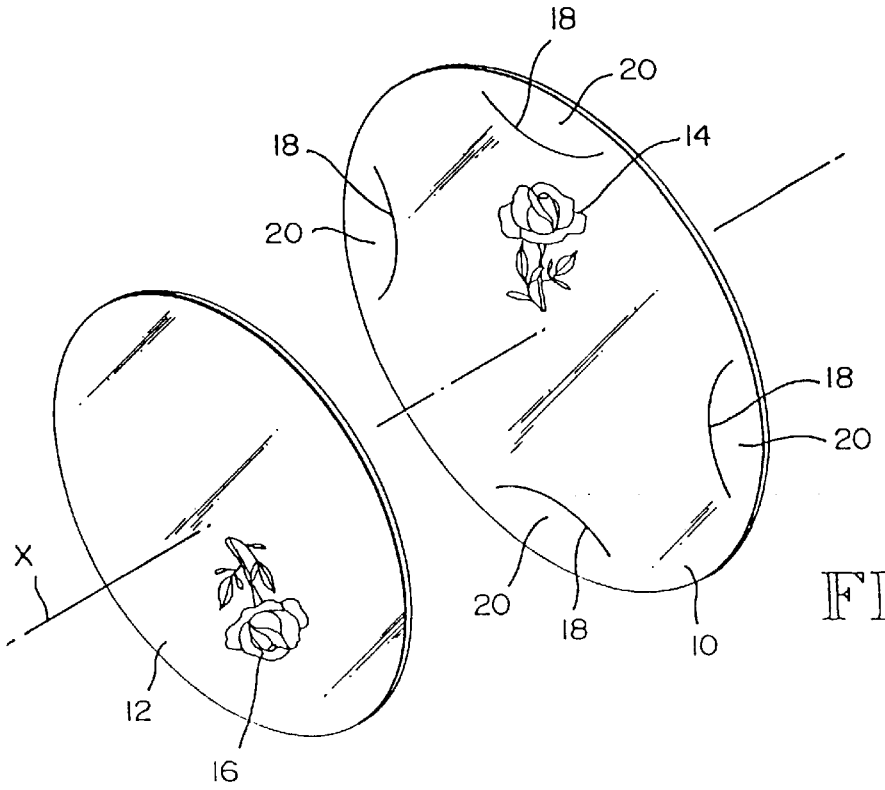
FIG. 1 is an exploded pictorial view of a first embodiment of the invention.
Figure 2:
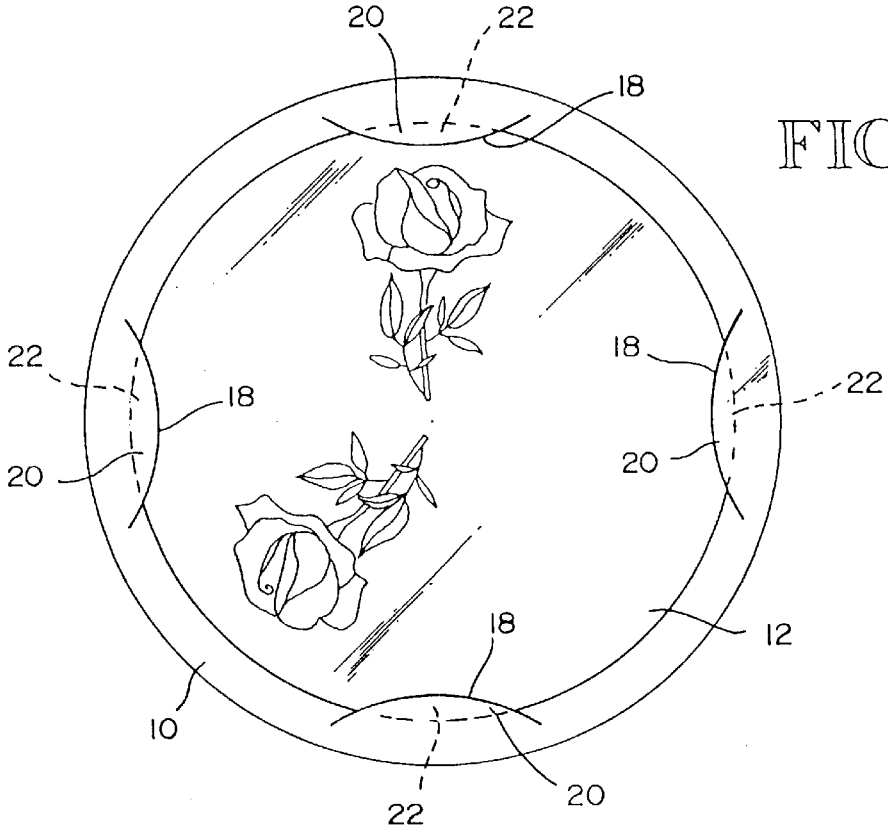
FIG. 2 is a side elevational view of the first embodiment of the invention, looking towards the second transparency side of the display and showing the second transparency connected to the first transparency.

FIGS. 1 and 2 show a first embodiment of the invention. It comprises a first plastic film transparency 10 and a second, smaller plastic film transparency 12. Herein, the term "transparency" means "a transparent object", much like a photographic slide. The term "transparent" mean "capable of transmitting light so that objects or images can be seen." "Plastic film" is used herein to mean a material much like the material from which photographic negatives and slides or other positives are made, but perhaps a little thicker and stiffer, e.g. LEXAN®. The image may be printed on the plastic film, using known printing techniques.

As previously stated, the second transparency 12 is slightly smaller in diameter than the first transparency 10.

First and second images 14, 16 are imprinted on the transparencies 10, 12. The design of the images 14, 16 can vary. For example, first transparency 10 and second transparency 12 can have identical images 14, 16 printed thereon, each with a full range of colors. By way of another example, each transparency 10, 12 can include partial images that when superimposed produce a desired combined image. The images 14, 16 may be partial in terms of the image itself and/or the colors that make up the combined image. In other words, image 14 may include only portions of a full image and/or portions of the colors of the full image, with image 16 including the remaining portion of the full image and/or colors of the full image.

Figure 3:
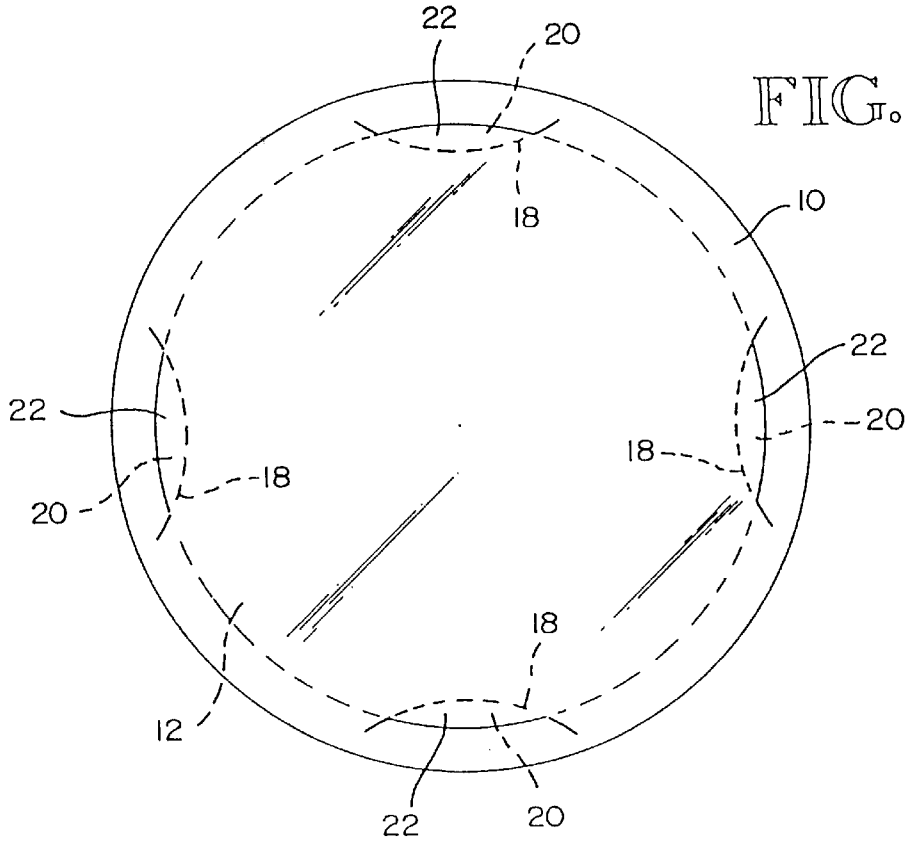
FIG. 3 is a view like FIG. 2, but looking towards the first transparency side of the display.

Regardless of the makeup of the images 14, 16, the transparencies 10, 12 are connected together in a manner that will now be described. The larger transparency 10 is formed to include a ring of arcuate incisions 18, spaced apart around its circumference. The incisions 18 form radially inwardly directed flaps 20. As best shown by FIG. 2, the smaller transparency 12 has film portions 22 that fit through the incisions 18 and project radially outwardly beyond the incisions 18, along side of the flaps 20. In the embodiment of FIGS. 1 and 2, the film portions of the smaller transparency 12 that project through the incisions 18 in the first transparency 10 are peripheral portions 22 of the second transparency 12. As will be apparent from FIGS. 1–3, the engagement of the peripheral portions 22 of the smaller transparency 12 with the incisions 18 and flaps 20 of the larger transparency 10 connects the smaller transparency 12 to the larger transparency 10 but in a way that allows the smaller transparency 12 to be rotated relative to the larger transparency 10 about axis x. As will be apparent, this construction allows a full three hundred and sixty degrees (360°) of rotation.

Figure 4:
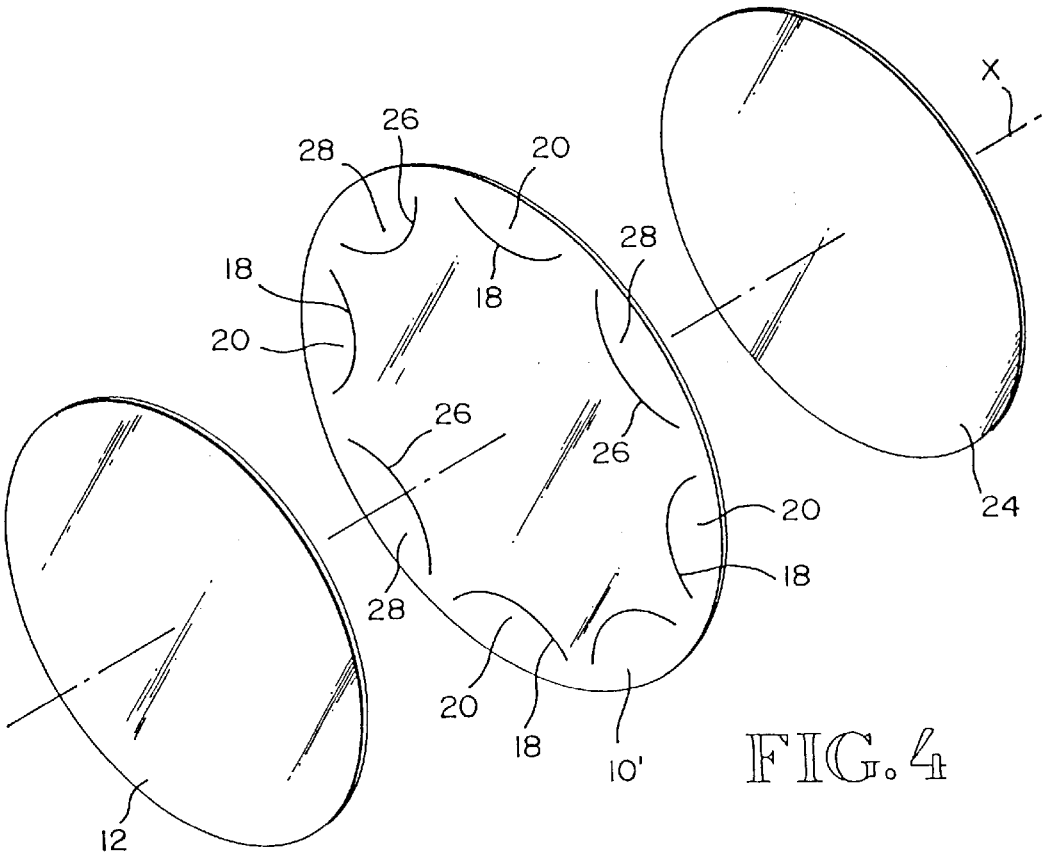
FIG. 4 is a view like FIG. 1, but of a second embodiment of the invention that is composed of a first, center transparency and smaller second and third side transparencies.
Figure 5:
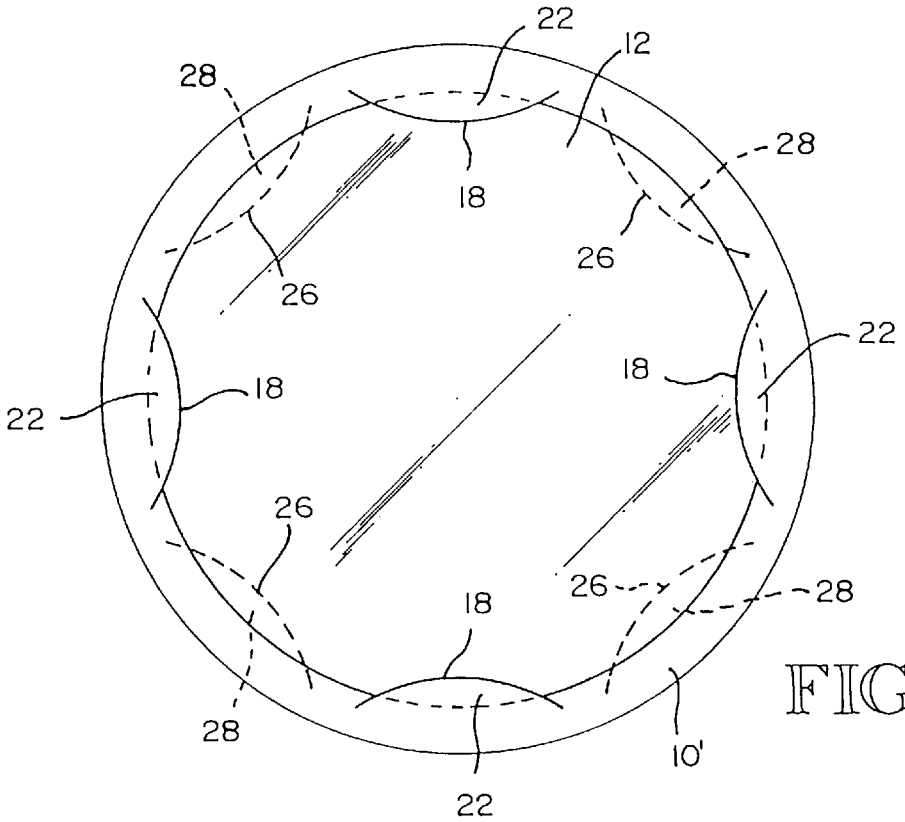
FIG. 5 is a view like FIG. 2, but of the embodiment show by FIG. 4.

FIGS. 4 and 5 show a second embodiment of the invention. It includes all of the features of the first embodiment and in addition includes a third transparency 24. As in the first embodiment, each of the transparencies 10', 12, 24 includes an image (not shown). The transparencies 12, 14 are rotatable relative to transparency 10', to bring the images into a predetermined position relative to each other, for the purpose of producing a combined image. As in the first embodiment, the separate images on the transparencies 10', 12, 24 may be partial in terms of the image itself and/or the colors that make up the combined image. In other words, each image may include portions of a full image and/or portions of the colors of a full image. Images on each transparency may be complementary to images on both of the other transparencies, who are only complementary to an image on one of the other transparencies.

In the embodiment of FIGS. 4 and 5, the larger diameter first transparency 10' includes a second group of incisions 26, forming a second group of flaps 28. As in the first embodiment, transparency 12 is positioned on one side of the transparency 20'. Peripheral portions 22 of the transparency 12 are inserted through the incisions 18, below the flaps 22. The third transparency 24 is on the opposite side of transparency 10'. It has peripheral portions that are inserted through the second incisions 26, inwardly of the flaps 28. As will be apparent from FIGS. 4 and 5, the incisions 18, 26 and the flaps 20, 28 serve to mount the second and third transparencies 12, 24 to the first transparency 10', for rotation about a axis x.

Figure 6:
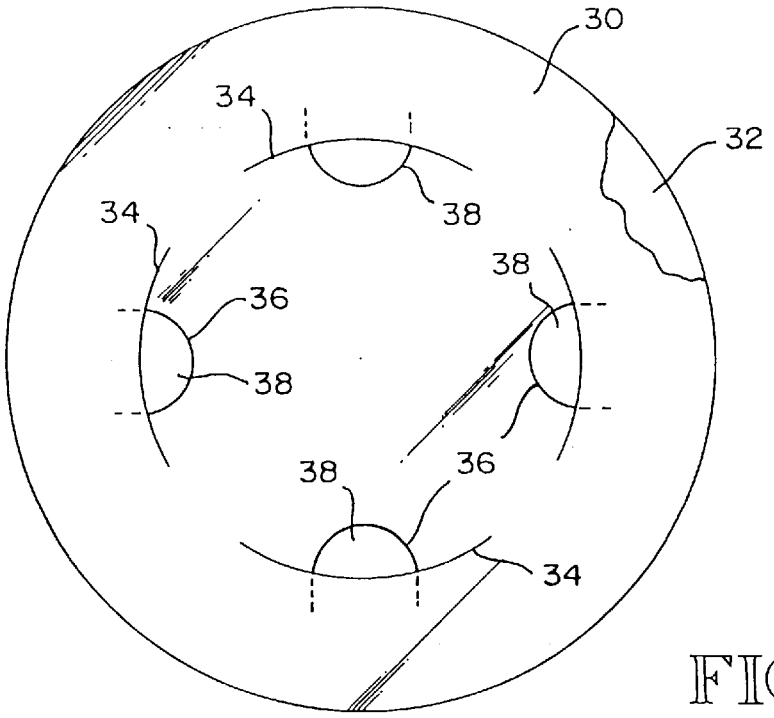
FIG. 6 is a side view of a third embodiment of the invention.

FIG. 6 shows a third embodiment of the invention. It includes two transparencies 30, 32, having the characteristics of the transparencies described above. However, transparencies 30, 32 may be either equal or unequal in diameter. In this 20 embodiment, the transparency 30 is provided with a ring of incisions 34 that constitute what might be referred to as "tracks." Transparency 32 includes incisions 36 that form flaps 38. In FIG. 6, transparency 30 is on the top and transparency is on the bottom. The flaps 38 project through the incisions 34. As clearly illustrated, flaps 38 are circumferentially narrower than the incisions or "tracks" 34. As a result, a limited:amount of rotation is permitted between transparencies 30, 32. Rotation may be for the purpose of aligning images, as discussed above, or may be for some other purpose. The incisions 36 may be formed to create outwardly projecting flaps. Also, incisions 34 may be made to be outwardly concave and inwardly convex.

Figure 7:
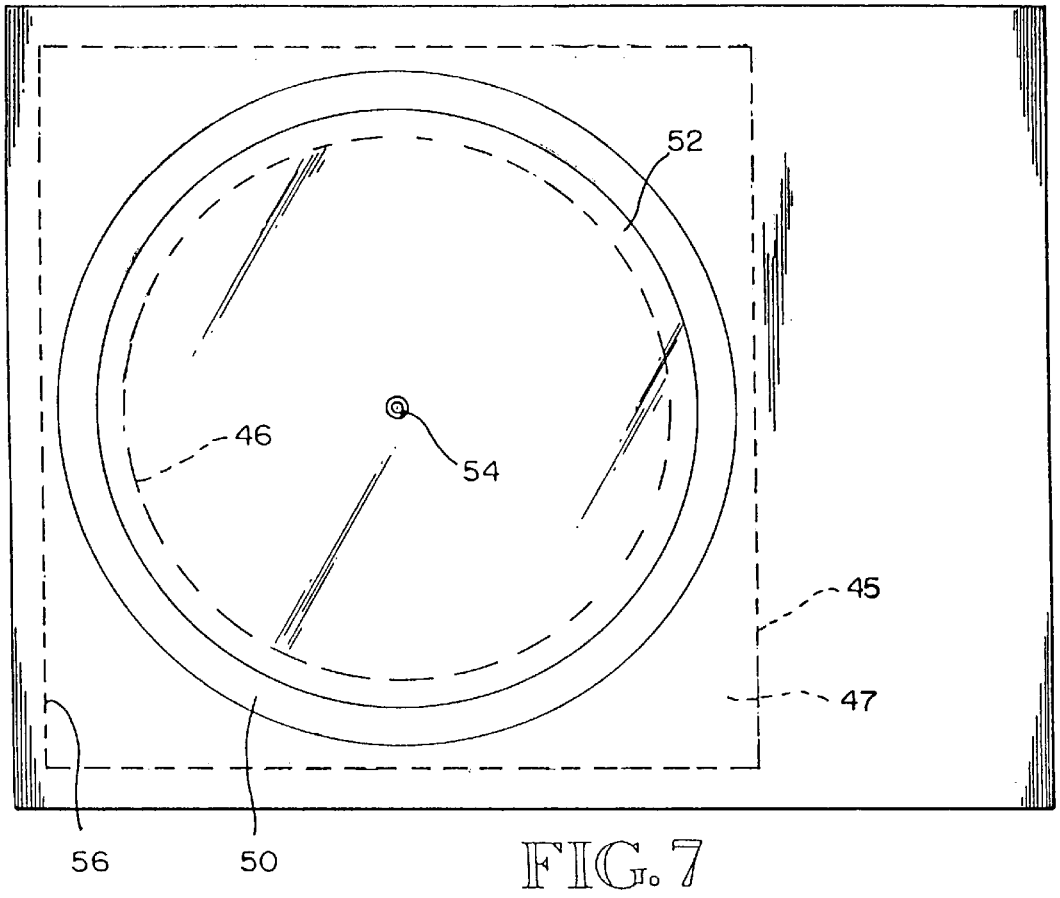
FIG. 7 is a sectional view of a fourth embodiment of the invention, taken substantially along line 7—7 of FIG. 8.
Figure 8:
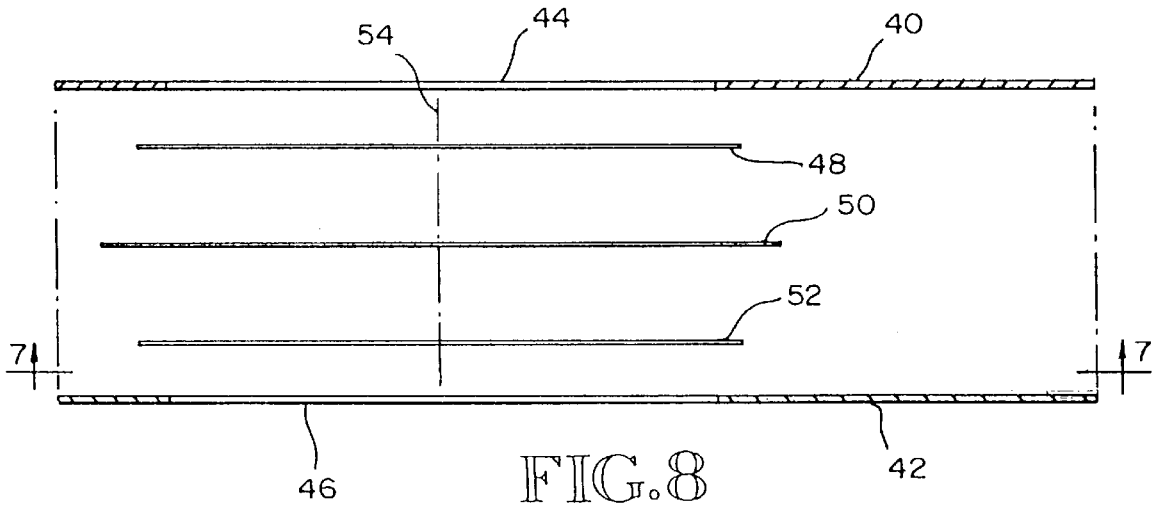
FIG. 8 is an exploded top plan view of the embodiment o:E the invention sown by FIG. 7.

FIGS. 7 and 8 show a fourth embodiment of the invention.

This embodiment includes an envelope that may be formed by 35 opposite sides or panels 40, 42, each being formed to include a side opening 44, 46. The two panels 40, 42 are brought together and are glued together outside of the border line 45.

Before this is done, two or three side-by-side transparencies are placed within a pocket or inner space 47 that is formed between the panel 40, 42, inwardly of the border line 45. The panels 40, 42 are not glued together in the region of the space or pocket 47. This embodiment includes three side-by-sidle transparencies 48, 50, 52. They are pivotally connected together at their centers by a pivot pin 54, such as disclosed in my U.S. Pat. No. 5,669,165. Or, they are connected together by the use of incisions and flaps such as used in the first three embodiments and described above. In any event, the transparencies 48, 50, 52 are provided with-a rotational axis 54. In this embodiment, when the transparencies 48, 50, 52 are trapped within the inner space 56, the outer two transparencies 48, 52 can be accessed through the side openings 44, 46. As clearly shown by FIG. 8, in this embodiment, all three transparencies 48, 50, 52 are larger in diameter than the side openings 44, 46. After the transparencies 48, 50, 52 have been positioned within the space 52, and the side panels 40, 42 are glued together, the display is ready for use. The side openings 44, 46 provide a way for one to reach around a side portion of the envelope and with a thumb and index finger grasp the outer transparencies 48, 52. The thumb and index finger are then pulled upon to slide the group of transparencies 48, 50, 52 against the side boundary of the space 46, such as the boundary 56, for example. When contact is made, the contact will hold the larger diameter inner transparency 50 against rotation relative to the envelope 40, 42. Once movement of the transparency 50 has been arrested, the person can manipulate his/her thumb and index finger to cause a rotation of one or both of transparencies 48, 42 relative to the others.

Figure 9:
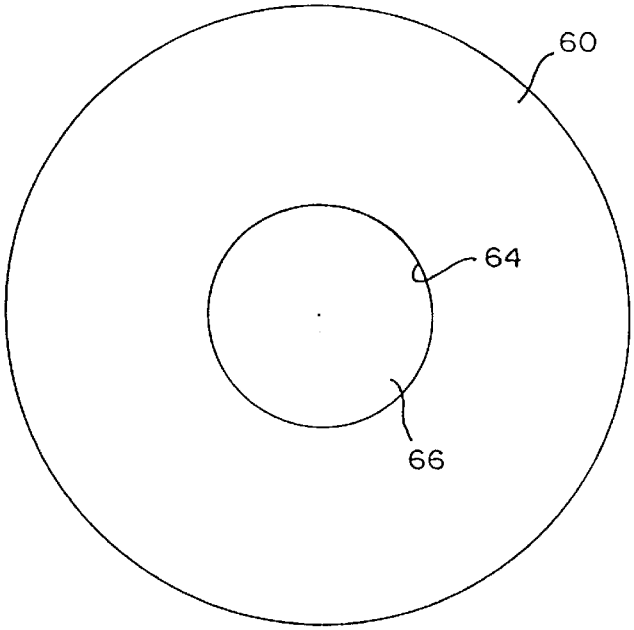
FIG. 9 is a side view of a first transparency that is a part of a fifth embodiment of the invention.
Figure 10:
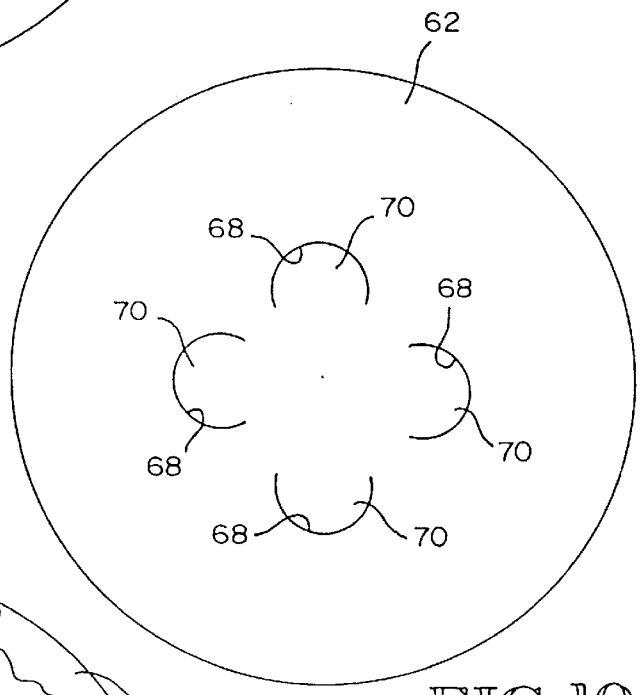
FIG. 10 is a side view of a second transparency that is a part of the fifth embodiment of the invention.
Figure 11:
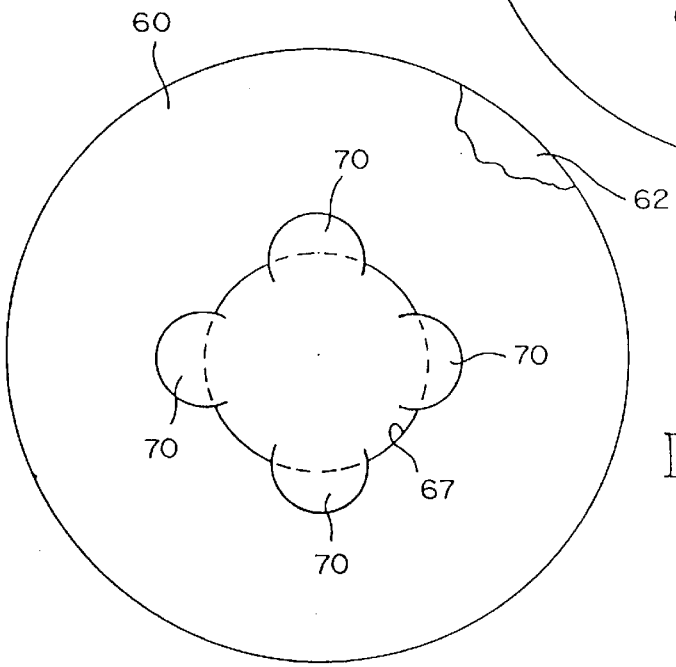
FIG. 11 is a view like FIGS. 9 and 10, but showing the two transparencies connected together.

FIGS. 9—11 show a fifth embodiment of the invention. It comprises a first transparency 60 and a second transparency 62. The transparencies 60, 62 are both shown to be circular and are shown to be equal in diameter. However, the diameters can be unequal. Also, the shape of one or both of the transparencies 60, 62 can be different. For example, one of the transparencies 60, 62 could be circular and the other square, with the distance across being equal to the diameter of the circular transparency. The two transparencies may be inserted in an envelope like the envelope shown in FIGS. 7 and 8, with the boundaries of the square transparency positioned closely adjacent the border line 44 of the inner space 46.

Referring to FIG. 9, transparency 90, is shown to include an incision 64 that is circular and forms a hole 66 in the center of the transparency 60. As shown by FIG. 10, transparency 62 may include incisions 68 forming flaps 70 in the transparency 62. The bases of the flaps 70 lie on a circle that is slightly smaller in diameter than the circle formed key incisions 64 in transparency 60.

FIG. 11 shows transparency 60 placed forwardly adjacent transparency 62. It further shows the flaps 70 repositioned to be forwardly of the film 60. This is done by bending the flaps 70 so that they will pass through the opening formed by incision 64. Once through the opening 64, the flaps 70 are released, allowing them to move into positions in which they overlap the film 70. As will be apparent, the engagement of the flaps 70 with the film material bordering the hole 66 mounts the transparencies 60, 62 for rotation, one relative to the other. As in the earlier embodiments, the film 60, 62 may be provided with images or partial images that when brought into a particular position, each to the other, will produce a combined image.

The illustrated embodiments are only examples of the present invention and, therefore, are non-limitive. It is to be understood that many changes in the particular structure, materials and features of the invention may be made without departing from the spirit and scope of the invention.

Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A display, comprising:

an envelope having opposite sides and an interior space, each of said sides having an opening in it, a plurality of plastic film transparencies, said plurality of transparencies comprising a first transparency and the remaining transparencies of said plurality of transparencies, said first of said transparencies having an image on it and each of said remaining transparencies of said plurality of transparencies having a complementary image on it, and a pivot pin, said plurality of transparencies being positioned side by side and connected together for relative rotation, each to the other by said pivot pin, said first of said plurality of transparencies being larger than, said remaining transparencies of said plurality of transparencies, said transparencies being positioned within said envelope and projecting radially into said interior space radially outwardly from said openings in said sides of said envelope and whereby said plurality of transparencies are graspable through said openings so that said larger first transparency can be moved sidewise into rotation preventing contact with an inner portion of said envelope and said remaining transparencies can each then be rotated relative to said first transparency.

* * * * *